US006851123B1

(12) United States Patent
Kleinert

(10) Patent No.: US 6,851,123 B1
(45) Date of Patent: Feb. 8, 2005

(54) BASEBALL GLOVE

(75) Inventor: James M. Kleinert, Louisville, KY (US)

(73) Assignee: Hillerich & Bradsby Co., Louisville, KY (US)

( * ) Notice: Subject to any disclaimer, the term of this patent is extended or adjusted under 35 U.S.C. 154(b) by 0 days.

(21) Appl. No.: 10/728,583

(22) Filed: Dec. 5, 2003

(51) Int. Cl.[7] ..... A41D 13/08
(52) U.S. Cl. ..... 2/19; 2/161.1
(58) Field of Search ..... 2/16, 19, 20, 159, 2/161.1

(56) References Cited

U.S. PATENT DOCUMENTS

| | | | | | |
|---|---|---|---|---|---|
| 1,552,080 | A | * | 9/1925 | Rainey | 2/19 |
| 3,042,929 | A | * | 7/1962 | Kobos | 2/19 |
| D213,287 | S | * | 2/1969 | Khazzam | D29/123 |
| 5,379,460 | A | * | 1/1995 | Aoki | 2/19 |
| 5,435,008 | A | * | 7/1995 | Shane | 2/16 |
| 5,575,005 | A | | 11/1996 | Walker et al. | |
| 5,592,688 | A | | 1/1997 | LaRonge et al. | |
| 5,717,994 | A | | 2/1998 | Goldsmith | |
| 5,887,282 | A | | 3/1999 | Lenhart | |
| 6,182,289 | B1 | | 2/2001 | Brown | |
| 6,253,382 | B1 | | 7/2001 | Kleinert | |
| 6,289,515 | B1 | | 9/2001 | Fous | |
| 6,389,601 | B2 | | 5/2002 | Kleinert | |
| 6,415,444 | B1 | | 7/2002 | Kleinert | |
| 6,453,474 | B2 | | 9/2002 | Kleinert | |
| 6,460,184 | B1 | | 10/2002 | Nishomira et al. | |
| 6,502,244 | B1 | | 1/2003 | Kleinert | |
| 6,516,470 | B1 | * | 2/2003 | Aoki | 2/19 |
| 6,516,471 | B1 | * | 2/2003 | Baumann | 2/19 |
| 6,571,394 | B1 | * | 6/2003 | Hackett et al. | 2/19 |
| 6,681,402 | B1 | * | 1/2004 | Bevier et al. | 2/19 |
| 2001/0025382 | A1 | | 10/2001 | Murai | |

* cited by examiner

*Primary Examiner*—Gary L. Welch
(74) *Attorney, Agent, or Firm*—Charles G. Lamb; Middleton Reutlinger

(57) ABSTRACT

A baseball glove is provided with improved flexibility for the use in the catching of baseballs and the like. The improved flexibility for the baseball glove includes an expandable material which extends over the carpometacarpal joint of the thumb and longitudinally towards a web section of the glove and then transversely across the metacarpalphangeal joints of the fingers. The webbing of the glove between the thumb stall and an index finger stall of the glove is provided with a thumb side web section and an index finger web section which are connected with a hinge member which runs along and spaced from the longitudinal side of the thumb stall and the index finger stall.

10 Claims, 4 Drawing Sheets

BASEBALL GLOVE

BACKGROUND OF THE INVENTION

1. Description of the Invention

This invention relates to gloves for the human hand which are worn when playing sports, such as baseball and softball.

More particularly this invention relates to a glove with enhanced flexibility and particularly useful by the young.

2. Description of Related Art

Glove construction for protection of the human hand is well known. In addition there are a number of patents which teach gloves claimed to be particularly useful when playing baseball, softball and the like. For example, U.S. Pat. No. 6,182,289 teaches a baseball glove which has enhanced flexibility which is particularly beneficial to ballplayers with developing hand-flex strength and, U.S. Pat. No. 4,817,209 teaches a child's baseball glove which includes an elongated padded retainer member detachably secured to opposite side portions of the pocket of the glove. Moreover, there have been a number of patents issued to Dr. James M. Kleinert which are directed to gloves, particularly for use in sports, which includes shock absorbing pads positioned for location above and below the center axis of rotation of selected joints of the fingers while the joints of the fingers themselves are absent of shock absorbing pads.

SUMMARY OF THE INVENTION

It is an object of the present invention to provide an improved ball catch glove for receiving or catching a baseball, softball or the like.

It is another object of the present invention to provide a youth baseball glove with enhanced flexibility.

It is a further object of the present invention to provide a baseball glove including flexible material located over the carpometacarpal joint of the thumb which extends distally to the webbing spaced between the thumb and index finger.

It is even a further object of the present invention to provide a baseball glove which includes a web hinge connection in the webbing of the glove between the thumb and the index finger for increasing the flexibility of movement of the web portion of a baseball glove.

More particularly, the present invention provides a ball glove which includes a dorsal side panel and a palmar side panel secured along each panel's outer periphery to define a glove body. The dorsal side panel is sized to cover a back of a human hand and the palmar side panel is sized to cover a palm of the hand. The dorsal side panel in conjunction with the palmar side panel provides a thumb stall and a plurality of finger stalls therebetween with an opening between the dorsal side panel and the palmer side panel to receive a human hand therein. The dorsal side panel is provided with an expandable dorsal side section which extends at a location between the thumb stall and a finger stall to receive the index finger wherein the expandable dorsal side section extends beyond the carpometacarpal joint of the thumb in a longitudinally direction to a location approximating the center axis of rotation of the metacarpalphalangeal joints of the finger stall to receive the index finger and transverse thereto across the metacarpalphalangeal joints of the finger stalls to receive the fingers of the human hand. Webbing is disposed between the thumb stall and the index finger stalls wherein the webbing is divided into a first web section and a second web section with a flexible hinge connection extending parallel to the index finger stall and the thumb stall separating the webbing into the first web section and the second web section. The first web section is attached to the hinge connection strip and the thumb stall and the second web section is attached to the hinge connection and along the first finger stall.

It is understood that in the application the use of the term "ball glove" refers to a catch glove for use in baseball, softball and the like and that the term "baseball" refers to baseball, softball and other types of games of catch involving a ball.

Further objects and advantages of the present invention will be made apparent from the accompanying drawings and the detailed description of these drawings.

BRIEF DESCRIPTION OF THE DRAWINGS

A better understanding of the invention will be had upon reference to the following description in conjunction with the accompanying drawings in which like numerals refer to like parts throughout the several views and wherein.

DETAILED DESCRIPTION OF THE PREFERRED EMBODIMENTS

Figure 2:
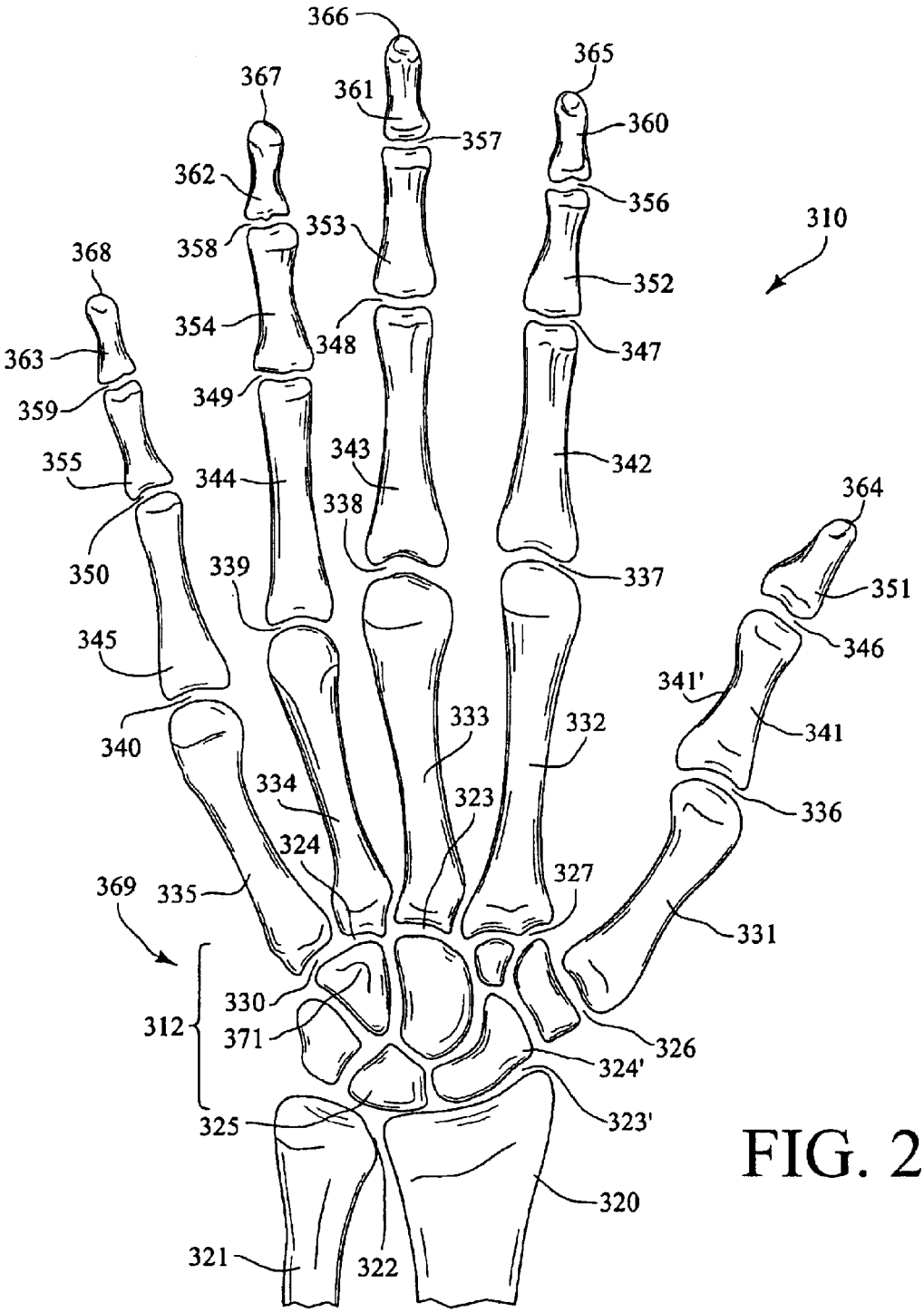
FIG. 2 is a schematic anatomical view of a left human hand showing the dorsal side of the human hand in detail.

FIG. 2 is a schematic anatomical view of the bones of a right human hand 310 looking at a palm side. Shown are the radius 320, ulna 321, radiocarpal joint (RC) 323', distal radio ulnar joint (DRUJ) 322, wrist 312, thumb 364, index finger 365, long finger 366, ring finger 367, and small finger 368. Also shown is a carpus 369 which comprises eight carpal bones, seven of which are shown in FIG. 2. This includes the hamate bone 371 with its hook-like protrusion, the scaphoid 324' and the lunate 325.

The thumb 364 is comprised of the distal phalanx 351, the interphalangeal joint (IP) 346, proximal phalanx 341, diaphysis proximal phalanx 341', metacarpalphalangeal joint (MCP) 336, metacarpal 331, and carpometacarpal joint (CMC) 326.

The index finger 365 is comprised of the distal phalanx 360, distal interphalangeal joint (DIP) 356, middle phalanx 352, proximal interphalangeal joint (PIP) 347, proximal phalanx 342, metacarpalphalangeal joint (MCP) 337, metacarpal 332, and carpometacarpal joint (CMC) 327.

The long finger 366 is comprised of the distal phalanx 361, distal interphalangeal joint (DIP) 357, middle phalanx 353, proximal interphalangeal joint (PIP) 348, proximal phalanx 343, metacarpalphalangeal joint (MCP) 338, metacarpal 333, and carpometacarpal joint (CMC) 323.

The ring finger 367 is comprised of the distal phalanx 362, distal interphalangeal joint (DIP) 358, middle phalanx 354, proximal interphalangeal joint (PIP) 349, proximal phalanx 344, metacarpalphalangeal joint (MCP) 339, metacarpal 334, and carpometacarpal joint (CMC) 324.

The small finger 368 is comprised of the distal phalanx 363, distal interphalangeal joint (DIP) 359, middle phalanx 355, proximal interphalangeal joint (PIP) 350, proximal phalanx 345, metacarpalphalangeal joint (MCP) 340, metacarpal 335, and carpometacarpal joint (CMC) 330.

Figure 1:
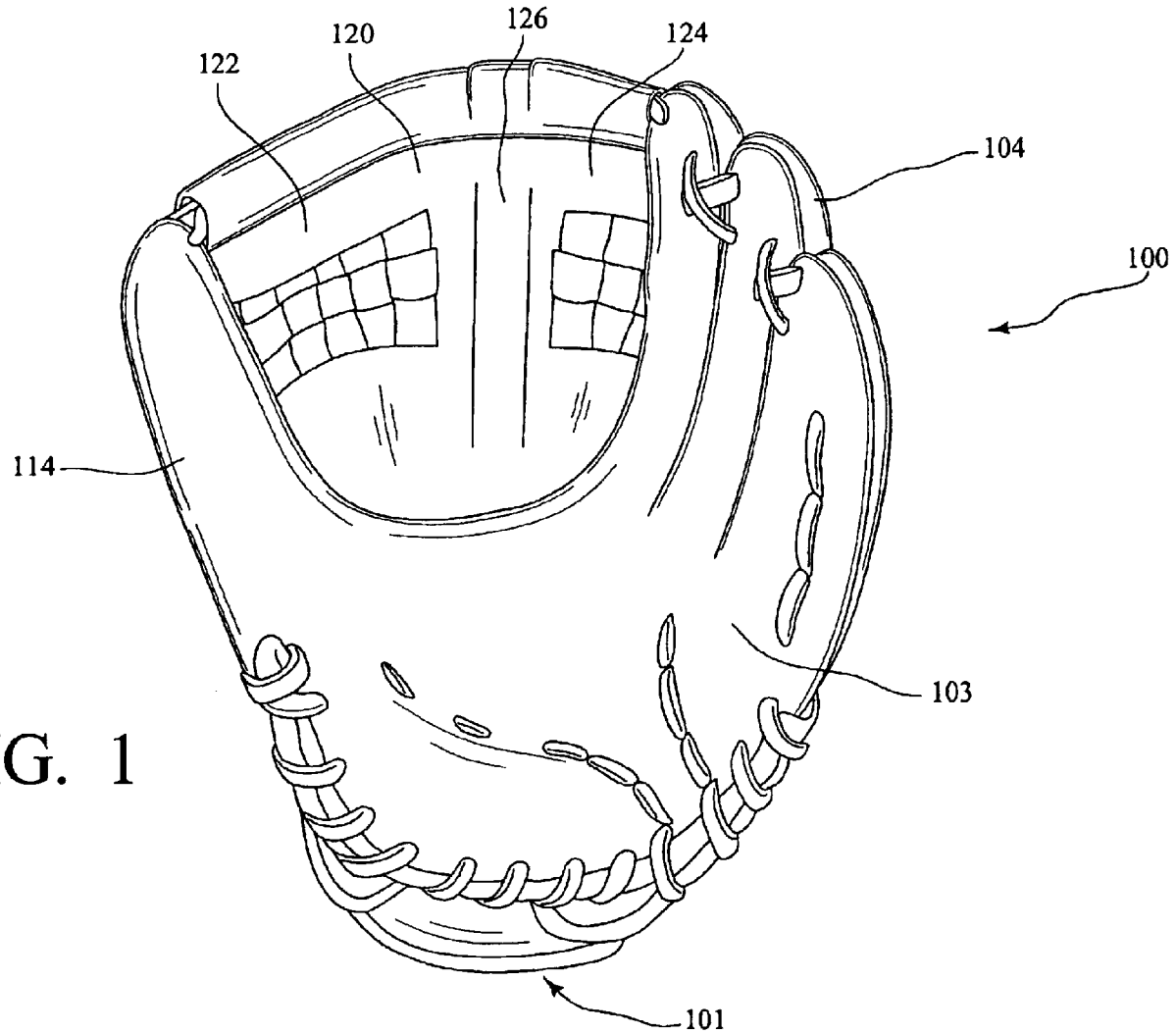
FIG. 1 is a perspective view of a baseball glove of the present invention shown from the palmar side of the glove.
Figure 3:
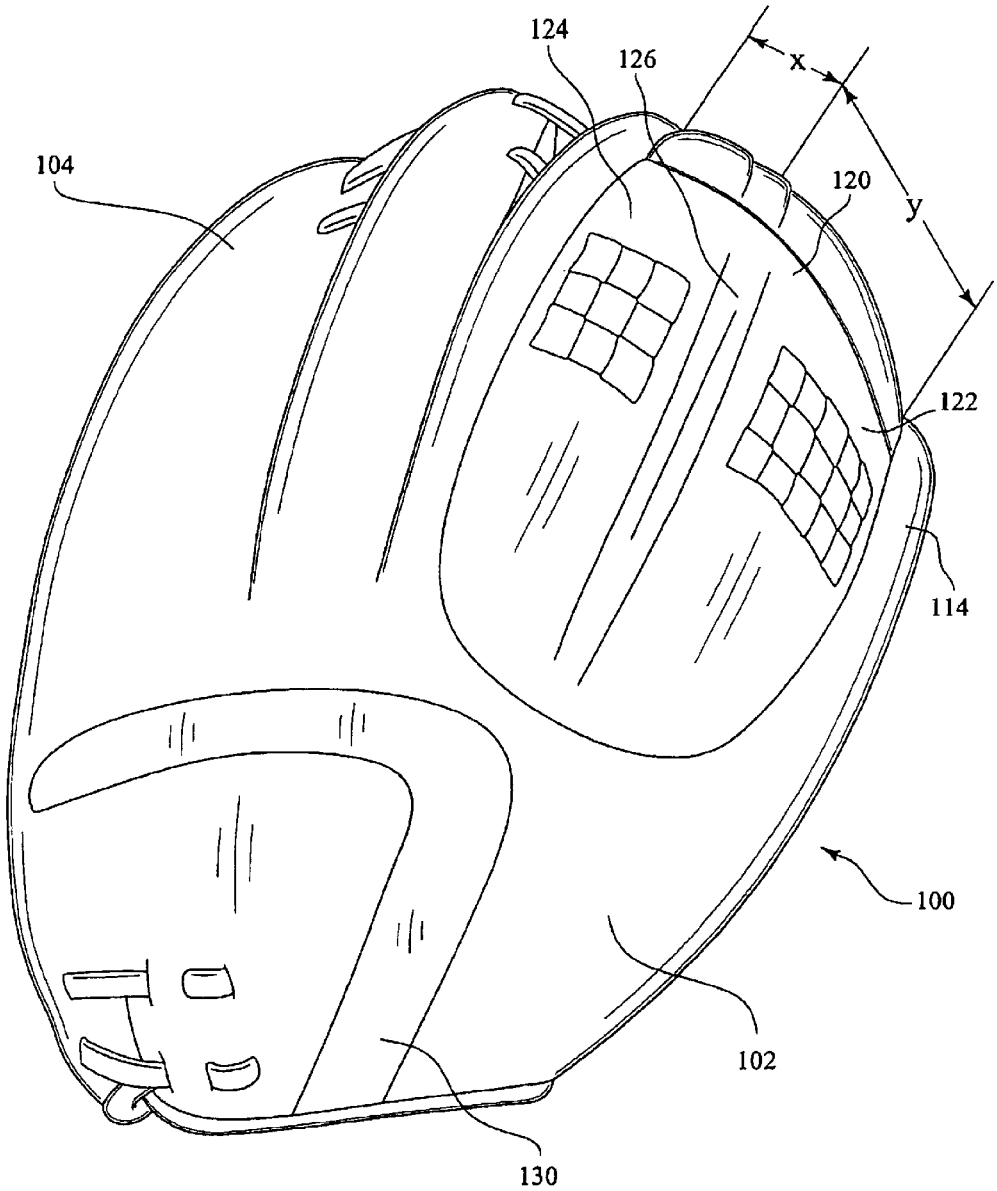
FIG. 3 is a perspective view of the baseball glove of FIG. 1 of the present invention shown from the dorsal side of the glove; and, FIG. 4 is a dorsal side view of the baseball glove of FIG. 3 showing the dorsal side detail and seen overlaying the skeletal structure of a left-dorsal-side human hand inserted into the baseball glove.
Figure 4:
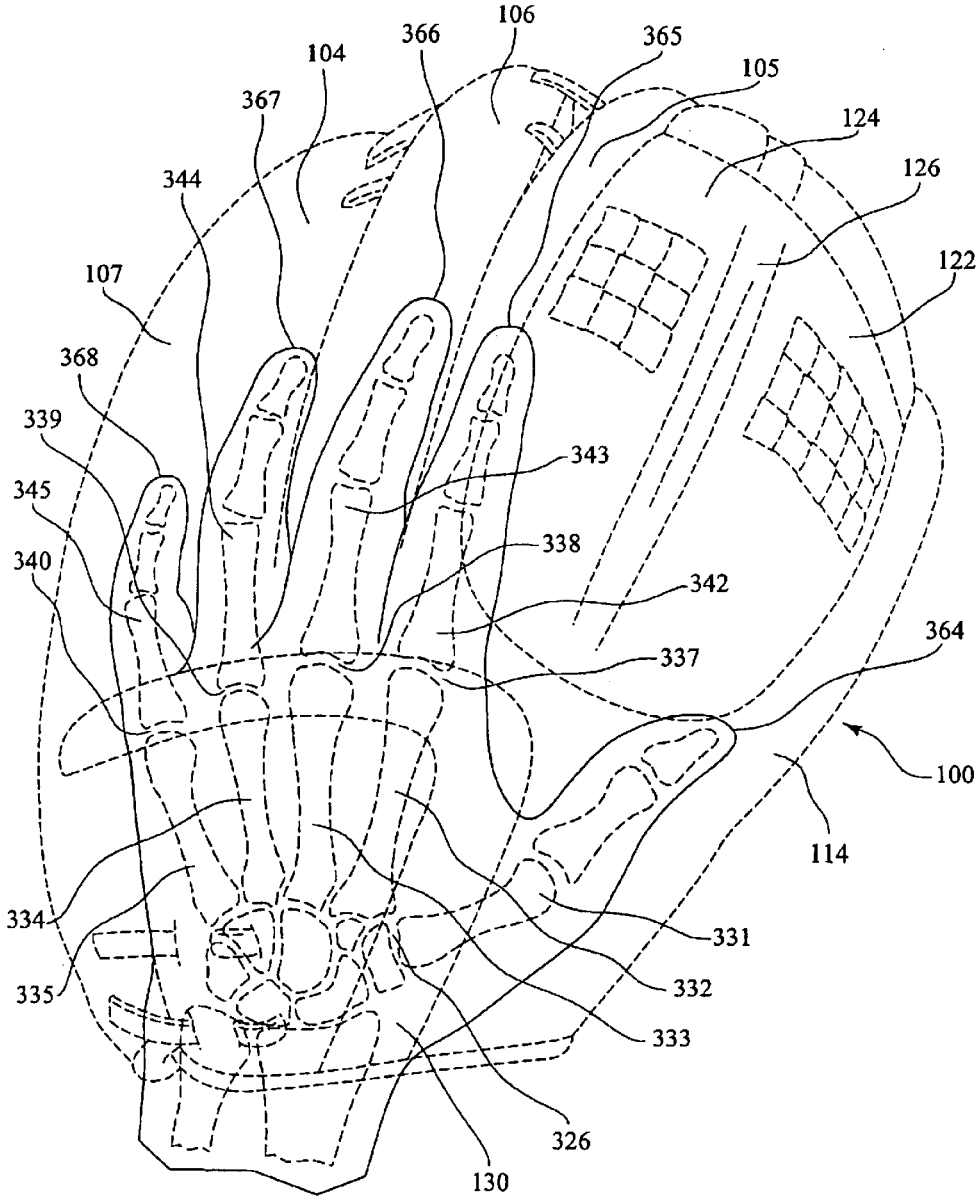

Referring now to FIGS. 1, 3 and 4, a preferred baseball glove 100 is provided for the left human hand. The glove 100 includes a dorsal side panel 102, as best shown in FIG. 3, and a palmar side panel 103, as best shown in FIG. 1, of suitable material, such as leather. The dorsal side panel 102 and the palmar side panel 103 are secured along the outer periphery, usually by lacing. A webbing 120 is attached to the glove 100 between the thumb stall 114 and the index finger stall 105. The webbing 120 includes a thumb side web section or first web section 122 and an index finger side web section or second web section 124 and are connected by a hinge member 126. The thumb side web section 122 and the index finger side section 124 are made in a conventional and well known manner for baseball gloves. The hinge member 126, which extends parallel to the index finger stall 105 and the thumb stall 114, is generally a thin, elongated flexible material such as leather or a fabric type material such as LYCRA® or the like. Moreover, the hinge member 126 may be a separate leather strip or it may be integral with the leather dorsal side panel 102. The hinge member 126 is closer to the index finger stall 105 than to the thumb stall 114. The distance between the center of the hinge member 126 and the index finger stall is noted by the letter "X" and the distance between the thumb stall 114 and the center of the hinge member 126 is noted by the letter "Y". In a preferred embodiment, "Y" will be approximately 60% to 75% between the distance between the thumb stall 114 and the index finger stall 105 and the distance "X" between the hinge connection 126 and the index finger stall 105 will be about 25% to 40% of the distance between the thumb stall 114 and the index finger stall 105.

The glove 100 is also provided with an expandable dorsal side section 130 which extends in a generally L-shaped configuration from the end of glove 100, which includes an opening 101 to receive the human hand, along the side of the thumb stall 114 and over the carpometacarpal joint 326 of the thumb 364. Expandable section 130 extends distally to just below the webbing 120 across the metacarpalphalangeal joint 337 of the index finger 365, the metacarpalphalangeal joint 338 of the long finger 366, the metacarpalphalangeal joint 339 of the ring finger 367, and the metacarpalphalangeal joint 340 of the small finger 36B.

In a preferred embodiment, as shown in FIG. 4, a plurality of finger stalls 104 are shown as including a finger stall 105 for receipt of the index finger 365, a finger stall 106 to receive the long finger 366 and a finger stall 107 to receive the ring finger 367 and the small finger 368. However, it is realized that individual finger stalls for each finger may be provided without departing from the scope and spirit of the present invention.

In the use of the baseball glove 100, the expandable dorsal side section 130 allows for increased flexibility across the metacarpalphalangeal joints 337–340 of the fingers and the carpometacarpal joint 326 of the thumb. And, particularly for youth players who have not developed strong joints, it enables the players to catch a ball with a lesser amount of stress on the joints. Moreover, the hinge member 126 allows for easy movement and flexibility between the thumb 364 and index finger 365 in closing the web once the ball has been received within the webbing 120 on the palm side of the glove 100.

The detailed description is given primarily for clearness of understanding and no unnecessary limitations are to be understood therefrom for modification will become obvious to those skilled in the art upon reading this disclosure and may be made without departing from the spirit of the invention and scope of the appended claims.

What is claimed is:

1. A ball glove comprising:

(a) a dorsal side panel and a palmar side panel secured along each panel's outer periphery to define a glove body, the dorsal side panel being sized to cover a back of a hand and the palmar side panel being sized to cover a palm of the hand, the dorsal side panel in conjunction with the palmar side panel providing a thumb stall and a plurality of finger stalls therebetween with an opening between said dorsal side panel and said palmar side panel to receive a hum hand therein;

(b) said dorsal side panel having an expandable dorsal side section 21 generally L-shaped configuration therein said expandable dorsal side section extending beyond the carpometacarpal joint of the thumb in a longitudinal direction to a location approximating the center axis of rotation of the metacarpalphalangeal joint of the finger stall to receive said index finger therein and transverse thereto across the metacarpalphalangeal joints of the location of the finger stalls to receive the index finger of the human hand; and, (c) a webbing disposed between said thumb stall and an index finger stall, said webbing having an outer periphery attached to at least one of said dorsal side panel or said palmar side panel.

2. The ball glove of claim 1, said webbing including a thumb side web section and an index finger side web section, said thumb side web section being attached along the periphery of the thumb stall and a longitudinally extending hinge member and the index finger side web section being attached along the outer periphery of the index finger stall and an opposed side of said index finger side web section being attached to said longitudinally extending hinge member.

3. The ball glove of claim 2 wherein said hinge member is closer to said index finger stall than said thumb stall.

4. The ball glove of claim 3 wherein the distance between the center of said hinge member and said thumb stall is approximately 1.5 to 3.0 times the distance between the index finger stall and the center of the hinge member.

5. The ball glove of claim 1, said expandable dorsal side section extending across the metacarpalphalangeal joints of the finger stalls to receive the long finger, ring finger, and small finger of the human hand.

6. A ball glove comprising:

(a) a dorsal side panel and a palmar side panel secured along each panel's outer periphery to define a glove body, the dorsal side panel being sized to cover a back of a hand and the palmar side panel being sized to cover A palm of the hand, the dorsal side panel in conjunction with the palmar side panel providing a thumb stall and a plurality of finger stalls therebetween with an opening between said dorsal side panel and said palmar side panel to receive a human hand therein; and, (b) a webbing disposed between said thumb stall and an index finger stall, said webbing having an outer periphery attached to at least one of said dorsal side panel or said palmar side panel, said webbing including a thumb side web section and an index finger tide web section, said thumb side web section being attached alone the periphery of the thumb stall and a longitudinally extending hinge member and the index finger aide web section being attached along the outer periphery of the index finger stall and an opposed side of said index finger side web section being attached to said longitudinally extending hinge member.

7. The ball glove of claim 6 wherein said hinge member is closer to said index finger stall than said thumb stall.

8. The ball glove of claim 7 wherein the distance between the center of said hinge member and said thumb stall is approximately 1.5 to 3.0 times the distance between the index finger stall and the center of the hinge member.

9. A ball glove comprising:

(a) a dorsal side panel and a palmar side panel secured along each panel's outer periphery to define a glove body, the dorsal side panel being sized to cover a back of a hand and the palmar side panel being sized to cover a palm of the hand, the dorsal side panel in conjunction with the palmar side panel providing a thumb stall and a plurality of finger stalls therebetween with an opening between-said dorsal side panel and said palmar side panel to receive a human hand therein; and, (b) said dorsal side panel having an expandable dorsal side section of generally L-shaped configuration, said expandable dorsal side section extending beyond the carpometacarpal joint of the thumb in a longitudinal direction to a location approximating the center axis of rotation of the metacarpalphalangeal joint of the finger stall to receive said index finger therein and transverse thereto across the metacarpalphalangeal joints of the location of the finger stalls to receive the index finger.

10. The ball glove of claim 9, said expandable dorsal side section extending across the metacarpalphalangeal joints of the finger stalls to receive the long finger, ring finger, and small finger of the human hand.

* * * * *